US010920430B1

(12) United States Patent
Kim

(10) Patent No.: US 10,920,430 B1
(45) Date of Patent: Feb. 16, 2021

(54) SUPPORT STRUCTURE FOR SUPPORTING FLOOR PANEL AND ACCESS FLOOR SYSTEM INCLUDING SUPPORT STRUCTURE

(71) Applicant: HAE KWANG CO., LTD., Chungcheongbuk-do (KR)

(72) Inventor: Myun Soo Kim, Gyeonggi-do (KR)

(73) Assignee: HAE KWANG CO., LTD.

( * ) Notice: Subject to any disclaimer, the term of this patent is extended or adjusted under 35 U.S.C. 154(b) by 0 days.

(21) Appl. No.: 16/679,847

(22) Filed: Nov. 11, 2019

(51) Int. Cl.
*E04F 15/024* (2006.01)
*E04F 15/02* (2006.01)

(52) U.S. Cl.
CPC .... *E04F 15/0247* (2013.01); *E04F 15/02194* (2013.01); *E04F 15/02405* (2013.01); *E04F 15/02452* (2013.01); *E04F 15/02458* (2013.01)

(58) Field of Classification Search
CPC ..... E04F 15/02452; E04F 15/02458; E04F 15/0247; E04F 15/02464; E04F 15/02194
USPC ..... 52/126.6, 263, 126.7
See application file for complete search history.

(56) References Cited

U.S. PATENT DOCUMENTS 4,630,417 A * 12/1986 Collier ..... F24F 7/10 52/263
4,703,921 A * 11/1987 Cutburth ..... B23Q 1/4804 269/47
5,787,663 A * 8/1998 Wehrmann ..... E04B 5/14 403/217
5,791,096 A * 8/1998 Chen ..... E04F 15/02458 52/126.6
8,429,860 B2 * 4/2013 Kugler ..... E04D 11/007 52/126.6
8,641,492 B2 * 2/2014 Meyer ..... H05K 7/20745 454/184
8,850,770 B2 * 10/2014 Roen ..... E04B 5/48 52/506.06
10,047,528 B1 * 8/2018 Kim ..... E04F 15/02452
2002/0078638 A1 * 6/2002 Huang ..... E04B 5/43 52/126.6
2013/0061453 A1 * 3/2013 Rosendahl ..... E04H 12/2261 29/525.11

* cited by examiner

*Primary Examiner* — Brian E Glessner
*Assistant Examiner* — Daniel J Kenny
(74) *Attorney, Agent, or Firm* — Tarolli, Sundheim, Covell & Tummino LLP

(57) ABSTRACT

Disclosed is a support structure on which a floor panel is seated. The support structure includes a first beam element disposed in a first direction; a second beam element disposed in a second direction perpendicular to the first direction; a post supporting the first beam element and the second beam element; and a pedestal seated on top of the post, and supporting the floor panel.

12 Claims, 11 Drawing Sheets

SUPPORT STRUCTURE FOR SUPPORTING FLOOR PANEL AND ACCESS FLOOR SYSTEM INCLUDING SUPPORT STRUCTURE

CROSS REFERENCE TO RELATED APPLICATION

The present application claims priority to Korean Patent Application No. 10-2019-0118362, filed Sep. 25, 2019, the entire contents of which is incorporated herein for all purposes by this reference.

BACKGROUND OF THE INVENTION

Field of the Invention

The present disclosure relates generally to a support structure. More particularly, the present disclosure relates to a support structure for supporting a floor panel in an access floor system, and an access floor system including the support structure.

Description of the Related Art

An access floor system is a system for forming a floor spaced apart from a foundation floor by a predetermined distance. The access floor system includes floor panels disposed spaced apart from the foundation floor by a predetermined distance and a support structure supporting the floor panels from the foundation floor.

The access floor system is used in clean rooms such as semiconductor fabrication labs for fabrication of semiconductors requiring high precision and integration, pharmaceutical labs, genetic engineering labs, and the like. Various equipment or piping can be installed in the space between the floor panels and the foundation floor.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a support structure including a pedestal so as to easily adjust a distance between a floor panel and a foundation floor in an access floor system, and an access floor system including the support structure.

In order to achieve the above objective, according to one aspect of the present disclosure, there is provided a support structure on which a floor panel is seated, the support structure including: a first beam element disposed in a first direction; a second beam element disposed in a second direction perpendicular to the first direction; a post supporting the first beam element and the second beam element; and a pedestal seated on top of the post, and supporting the floor panel.

According to another aspect of the present disclosure, there is provided an access floor system, including: a floor panel; and a support structure supporting the floor panel, wherein the floor panel includes multiple unit panels, and the support structure includes: a first beam element disposed in a first direction; a second beam element disposed in a second direction perpendicular to the first direction; a post supporting the first beam element and the second beam element; and a pedestal seated on top of the post, and supporting the floor panel.

The support structure according to the embodiments of the present disclosure includes the pedestal that is height-adjustable, and thus there is an advantage of efficiently adjusting the distance between the support structure and the floor panel.

According to the support structure according to the present disclosure, there is another advantage in that the pedestal is easy to move on the first and second beam elements, without requiring provision of any separate structure formed on the first and second beam elements for movement the pedestal, thus simplifying a manufacturing process.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
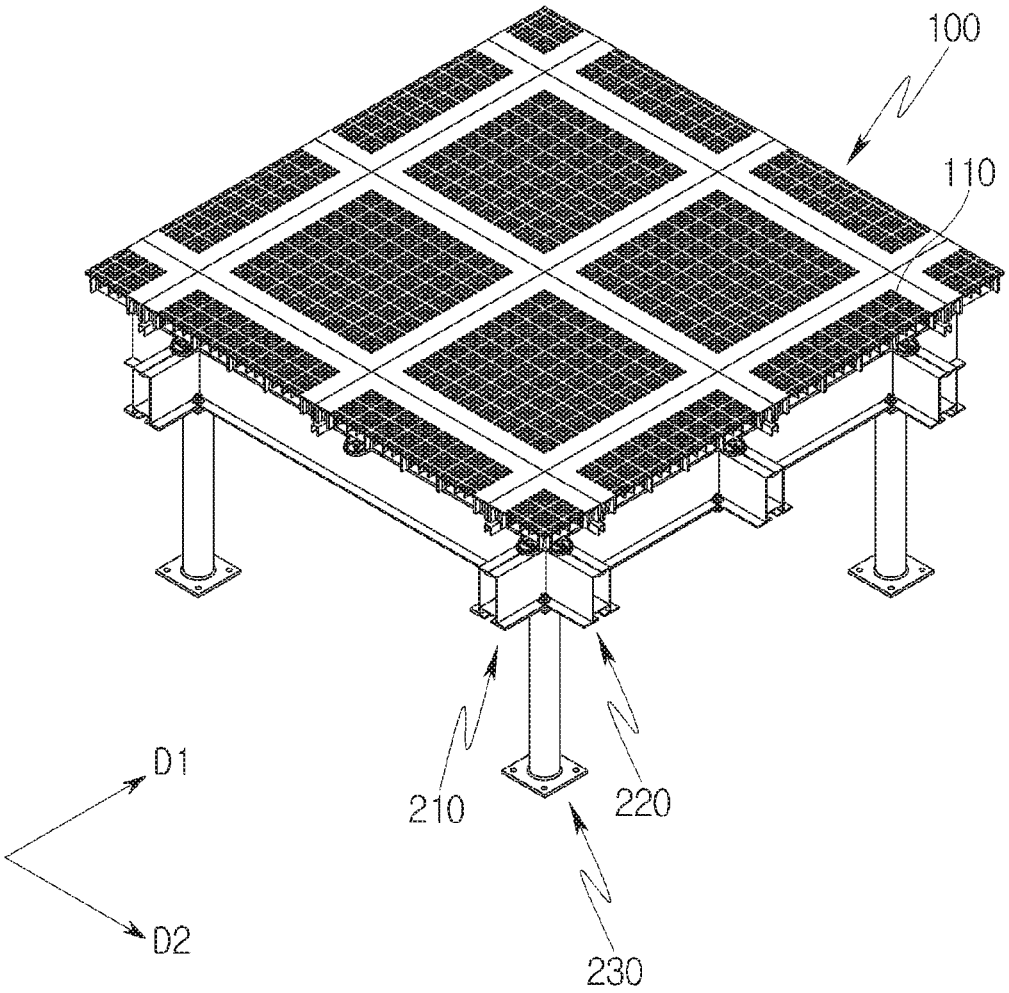
FIG. 1 is a view showing an access floor system according to embodiments of the present disclosure.

Hereinbelow, exemplary embodiments of the present disclosure will be described in detail with reference to the accompanying drawings. Throughout the drawings, the same reference numerals will refer to the same or like parts.

FIG. 1 is a view showing an access floor system according to embodiments of the present disclosure. Referring to FIG. 1, the access floor system 10 includes a floor panel 100 and a support structure 200. The floor panel 100 may refer to a flooring material used in a clean room or a computer room. The floor panel 100 is installed at a predetermined distance from a foundation floor by the support structure 200 as will be described later.

In some embodiments, the floor panel 100 may include multiple unit panels 110, and the multiple unit panels 110 may be arranged on the support structure 200 in a grid arrangement to form an access floor.

The support structure 200 supports the floor panel 100 seated on the support structure 200. The support structure 200 is installed on the foundation floor to maintain the floor panel 100 spaced apart from the foundation floor by a predetermined distance. For example, the predetermined distance may exceed the length of one side of each of the unit panels 110 of the floor panel 100.

The support structure 200 includes first beam elements 210, second beam elements 220, and a post 230.

The first beam elements 210 are arranged to form a first beam element array, and the second beam elements 220 are arranged to form a second beam element array. The first beam elements 210 and the second beam elements 220 are coupled to each other in a perpendicular arrangement. In some embodiments, multiple first beam element arrays may be arranged spaced apart and parallel to each other in first directions D1, and multiple second beam element arrays may be arranged spaced apart and parallel to each other in second directions D2. The first directions D1 and the second directions D2 may be perpendicular to each other. Herein, an arrangement interval of the first beam element arrays and an arrangement interval of the second beam element arrays may correspond to the length (or width) of each of the unit panels 110 of the floor panel 100.

The first beam elements 210 and the second beam elements 220 have the same height. For example, upper surfaces of the first beam elements 210 and upper surfaces of the second beam elements 220 may be included in the same plane.

The first beam elements 210 and the second beam elements 220 are manufactured by an aluminum extrusion method. Such a method has an advantage in that there is less limitation on a cross-sectional shape of the first beam elements 210 and the second beam elements 220, and thus the beam elements 210 and 220 are reduced in weight and are easy to manufacture.

In some embodiments, each of the first beam elements 210 and the second beam elements 220 may be formed into a hollow body having a rectangular cross-section, but is not limited thereto. For example, each of the first beam elements 210 and the second beam elements 220 may be formed into shape steel of H, L or like shape in cross-section, shape steel of polygonal shape in cross-section, and the like.

The post 230 is coupled to the first beam elements 210 and the second beam elements 220 to support the first beam elements 210 and the second beam elements 220. In some embodiments, the post 230 may support the first beam elements 210 and the second beam elements 220 at a location under an intersecting portion of the first beam elements 210 and the second beam elements 220.

In some embodiments, the post 230 may be manufactured such that the height thereof corresponds to the design height of the floor panel 100.

Figure 2:
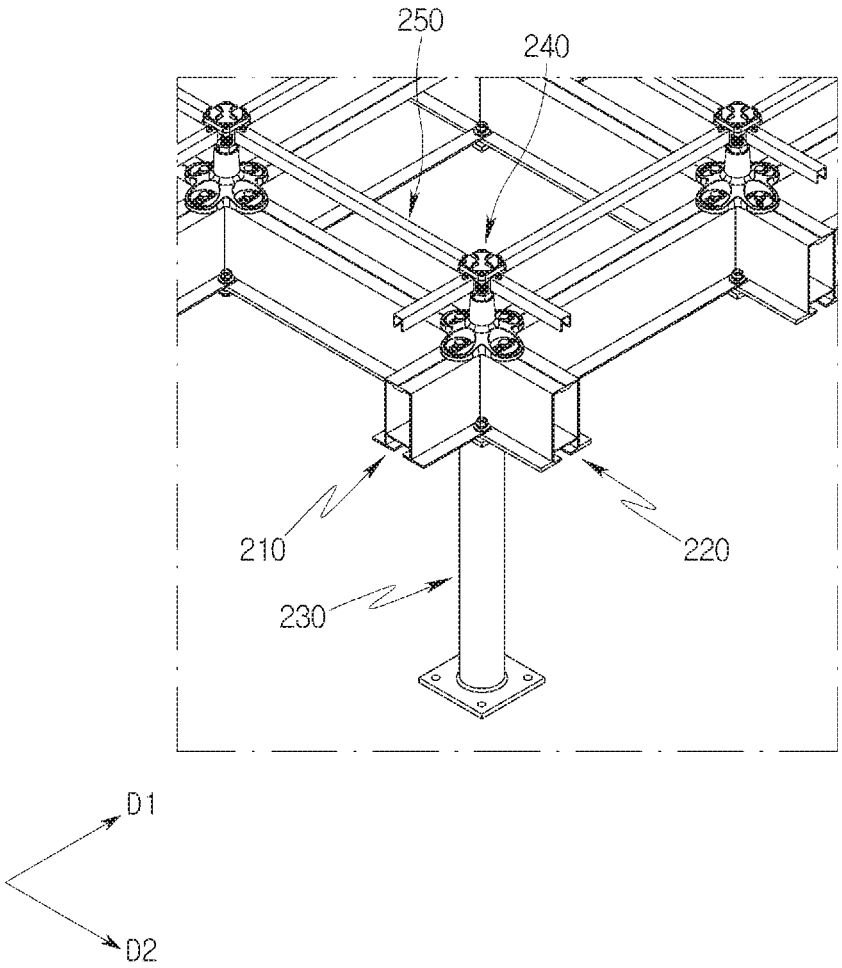
FIG. 2 is a perspective view showing a support structure according to embodiments of the present disclosure.

FIG. 2 is a perspective view showing a support structure according to embodiments of the present disclosure. FIG. 2 shows the support structure 200, with the floor panel 100 removed. Referring to FIGS. 1 and 2, the support structure 200 further includes a pedestal 240 and stringers 250.

The pedestal 240 is seated on the post 230 and supports the floor panel 100. In some embodiments, the floor panel 100 may be seated on the pedestal 240. For example, when the unit panels 110 of the floor panel 100 are arranged in a grid arrangement, the pedestal 240 may support an intersecting point of the unit panels 110. That is, four unit panels 110 neighboring each other may be seated on one pedestal 240.

The pedestal 240 is configured to be height-adjustable, such that the level of the floor panel 100 is adjusted.

According to embodiments of the present disclosure, provision of the pedestal 240 has an advantage of reducing deformation between the first beam elements 210 and the second beam elements 220, while improving coupling between the first beam elements 210 and the second beam elements 220.

The stringers 250 are connected to the pedestal 240 to support the floor panel 100 together with the pedestal 240, thus reinforcing a horizontal support force of the pedestal 240. In some embodiments, the stringers 250 may extend in the same direction as the first beam elements 210 (i.e., a first direction D1) and in the same direction as the second beam elements 220 (i.e., a second direction D2), and the floor panel 100 may be disposed on the stringers 250.

The stringers 250 connect and fix neighboring pedestals 240 to each other, thus reinforcing the horizontal support force of the pedestals 240.

Figure 3:
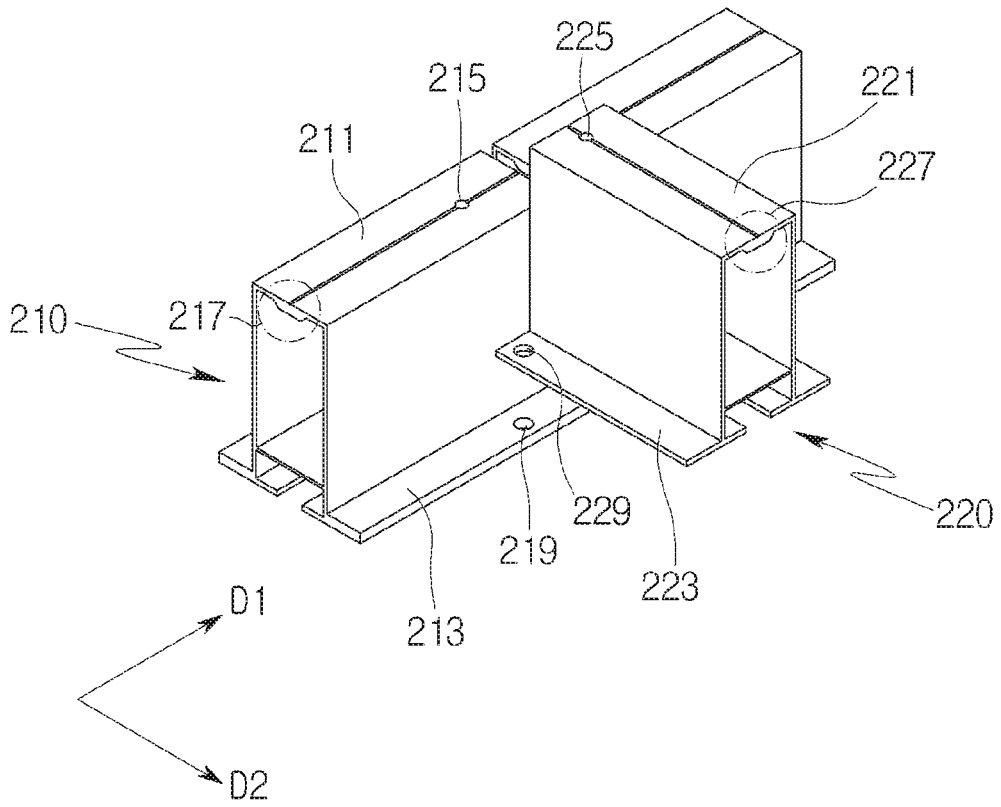
FIG. 3 is a view showing beam elements according to embodiments of the present disclosure.

FIG. 3 is a view showing beam elements according to embodiments of the present disclosure. Referring to FIGS. 1 to 3, each of the first beam elements 210 includes a first body portion 211 and a first wing 213, and each of the second beam elements 220 includes a second body portion 221 and a second wing 223.

The first body portion 211 includes a first upper hole 215 and a first groove 217. In some embodiments, the first upper hole 215 and the first groove 217 may be formed in an upper surface of the first body portion 211.

The first upper hole 215 is formed in the upper surface of the first body portion 211. In some embodiments, the first upper hole 215 may be formed on the center line (e.g., the center line in the first direction) of the upper surface of the first body portion 211, but is not limited thereto.

The first groove 217 is formed in the upper surface of the first body portion 211. The first groove 217 is formed to extend in an extending direction of the first beam element 210. In some embodiments, the first groove 217 may be formed along the center line (e.g., the center line in the first direction) of the upper surface of the first body portion 211, but is not limited thereto.

The first wing 213 extends from each lower end of the first body portion 211 and supports the first body portion 211 at the lower end of the first body portion 211. In some embodiments, the respective first wings 213 may extend oppositely outward from the first body portion 211 along a width direction of the first body portion 211.

Each of the first wings 213 includes a first lower hole 219. The first lower hole 219 is formed in the first wing 213. In some embodiments, multiple first lower holes 219 may be provided in the first wings 213, and the multiple first lower holes 219 may be symmetrically arranged with respect to the first body portion 211. For example, when two first lower holes 219 are provided in the respective first wings 213, one of the two first lower holes 219 and a remaining one may be arranged symmetrical to each other with respect to the first body portion 211.

The second body portion 221 includes a second upper hole 225 and a second groove 227. In some embodiments, the second upper hole 225 and the second groove 227 may be formed in an upper surface of the second body portion 221.

The second upper hole 225 is formed in the upper surface of the second body portion 221. In some embodiments, the second upper hole 225 may be formed on the center line (e.g., the center line in the second direction) of the upper surface of the second body portion 221, but is not limited thereto.

The second groove 227 is formed in the upper surface of the second body portion 221. The second groove 227 is formed to extend in an extending direction of the second beam element 220. In some embodiments, the second groove 227 may be formed along the center line (e.g., the center line in the second direction) of the upper surface of the second body portion 221, but is not limited thereto.

The second wing 223 extends from each lower end of the second body portion 221 and supports the second body portion 221 at the lower end of the second body portion 221. In some embodiments, the respective second wings 223 may extend oppositely outward from the second body portion 221 along a width direction of the second body portion 221.

Each of the second wings 223 includes a second lower hole 229. The second lower hole 229 is formed in the second wing 223. In some embodiments, multiple second lower holes 229 may be provided in the second wings 223, and the multiple second lower holes 229 may be symmetrically arranged with respect to the second body portion 221. For example, when two second lower holes 229 are provided in the respective second wings 223, one of the two second lower holes 229 and a remaining one may be arranged symmetrical to each other with respect to the second body portion 221.

The first beam elements 210 and the second beam elements 220 are coupled to each other through the lower holes 219 and 229. In some embodiments, the second wings 223 of the second beam elements 220 may be seated on the first wings 213 of the first beam elements 210 with respect to the first lower holes 219 and the second lower holes 229, and beam element connecting members may be coupled to the post 230 by passing through the first lower holes 219 and the second lower holes 229, whereby the first beam elements 210 and the second beam elements 220 may be coupled to each other.

Figure 4:
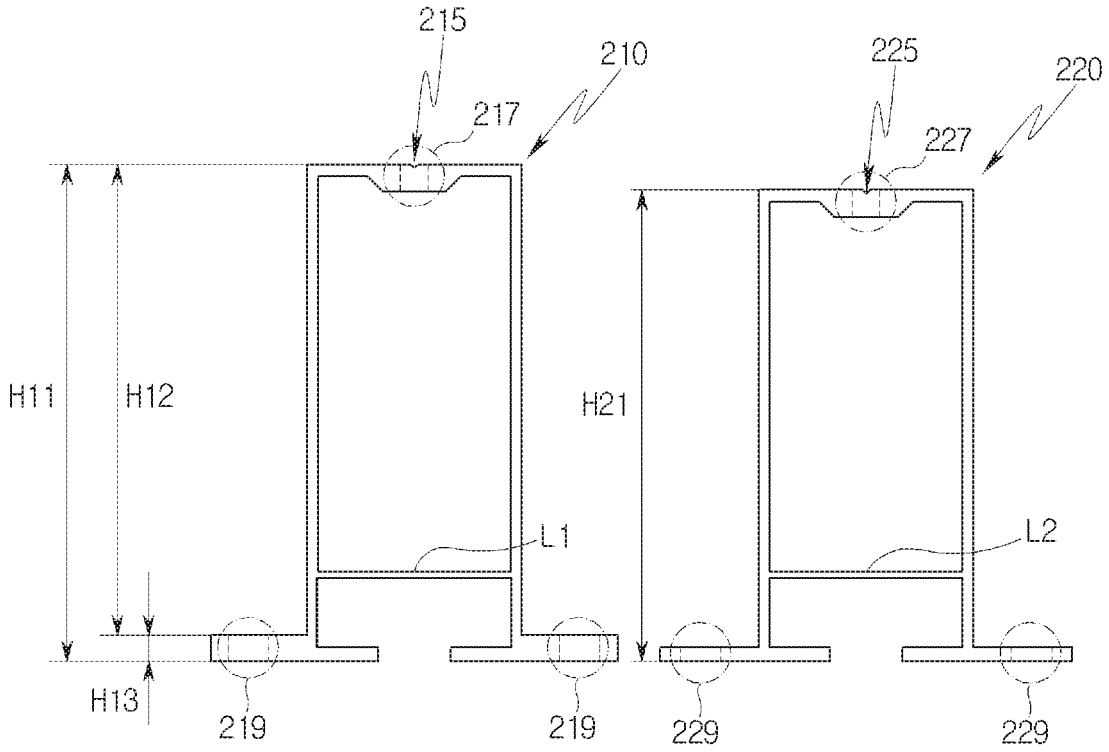
FIG. 4 is a view showing cross-sections of the beam elements according to embodiments of the present disclosure.

FIG. 4 is a view showing cross-sections of the beam elements according to embodiments of the present disclosure. Referring to FIGS. 1 to 4, a portion of the upper surface of each of the first beam elements 210 where the first upper hole 215 is formed is larger in thickness than a remaining portion. Similarly, a portion of the upper surface of each of the second beam elements 220 where the second upper hole 225 is formed is larger in thickness than a remaining portion. In some embodiments, each of the first and second beam elements 210 and 220 may include a central portion and a peripheral portion, and the central portion may be larger in thickness than the peripheral portion. That is, the upper surface of each of the first and second beam elements 210 and 220 may have a thicker central portion than a peripheral portion. Due to this difference in thickness, it is ensured that structural stability of the first and second beam elements 210 and 220 is secured despite of the first and second upper holes 215 and 225 formed in the first and second beam elements 210 and 220.

The first and second beam elements 210 and 220 include first and second inner walls L1 and L2, respectively. The first inner wall L1 is formed to be connected to an inner surface of the first beam element 210, and the second inner wall L2 is formed to be connected to an inner surface of the second beam element 220. In some embodiments, the first and second inner walls L1 and L2 may be formed to be parallel to the upper surfaces of the beam elements 210 and 220, respectively. The first and second inner walls L1 and L2 serve to suppress deformation of the first and second beam elements 210 and 220, which may occur during formation of the first and second beam elements 210 and 220. For example, the first and second inner walls L1 and L2 may suppress shrinkage and expansion of the first and second beam elements 210 and 220, which may occur when the first and second beam elements 210 and 220 are manufactured by an extrusion method.

Meanwhile, due to the fact that the first beam elements 210 and the second beam elements 220 are coupled to each other, with the second wings 223 of the second beam elements 220 seated on the first wings 213 of the first beam elements 210, each of the first beam elements 210 may have a height H11 greater than a height H21 of each of the second beam elements 220.

In some embodiments, the height H11 of each of the first beam elements 210 may be equal to the sum of a height H12 of the first body portion 211 and a height H13 of each of the first wings 213, and the height H21 of each of the second beam elements 220 may be equal to the height H12 of the first body portion 211 of the first beam element 210. Accordingly, even when the second beam elements 220 are seated on and coupled to the first beam elements 210, the upper surfaces of the first beam elements 210 and the upper surfaces of the second beam elements 220 are included in the same plane. This therefore has an advantage in that the level of the floor panel 100 is maintained.

Figure 5:
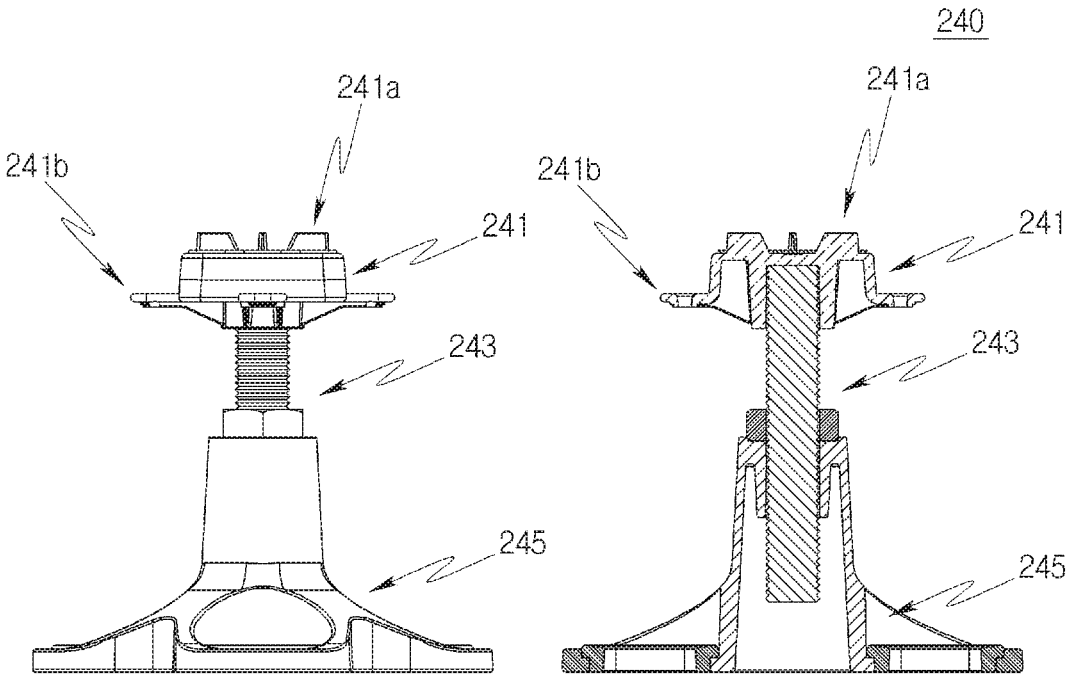
FIG. 5 is a view showing a pedestal according to embodiments of the present disclosure.

FIG. 5 is a view showing a pedestal according to embodiments of the present disclosure. Referring to FIGS. 1 to 5, the pedestal 240 includes a head portion 241, a connection portion 243, and a base portion 245.

The head portion 241 is disposed on top of the pedestal 240 to support the floor panel 100. In some embodiments, seat guide portions 241*a* may be provided on the head portion 241 to divide an area where the unit panels 110 of the floor panel 100 are seated.

The seat guide portions 241*a* are provided on the head portion 241 in cross directions to divide an upper surface of the head portion 241 into four sections, and the unit panels 110 are seated in the respective four sections. For example, the seat guide portions 241*a* may protrude from the upper surface of the head portion 241 by a predetermined thickness, and the unit panels 110 of the floor panel 100 may be arranged between the protruding seat guide portions 241*a*.

In some embodiments, the head portion 241 may include stringer connection portions 241*b* for connecting the stringers 250 and the pedestal 240 to each other. In some embodiments, the stringers 250 may be connected to the pedestal 240 through the stringer connection portions 241*b*. For example, the stringer connection portions 241*b* may extend from the head portion 241 in the first direction D1 and the second direction D2.

The connection portion 243 connects the head portion 241 and the base portion 245 to each other. In some embodiments, the connection portion 243 may be inserted into the head portion 241 and the base portion 245 and may be height-adjustable. For example, the connection portion 243 may include a bolt inserted into the head portion 241 and the base portion 245, and a nut coupled to the bolt.

The base portion 245 supports the pedestal 240. In some embodiments, the base portion 245 may be seated on the post 230 to support the pedestal 240.

Figure 6:
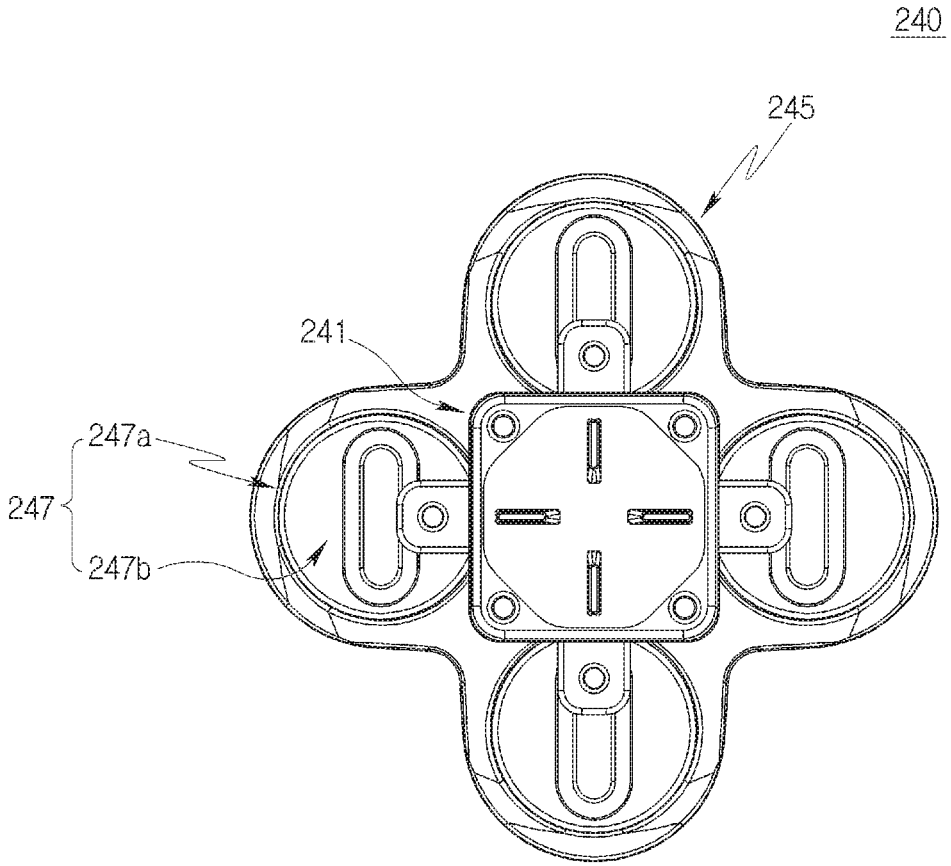
FIG. 6 is a view showing an upper surface of the pedestal according to embodiments of the present disclosure.
Figure 7:
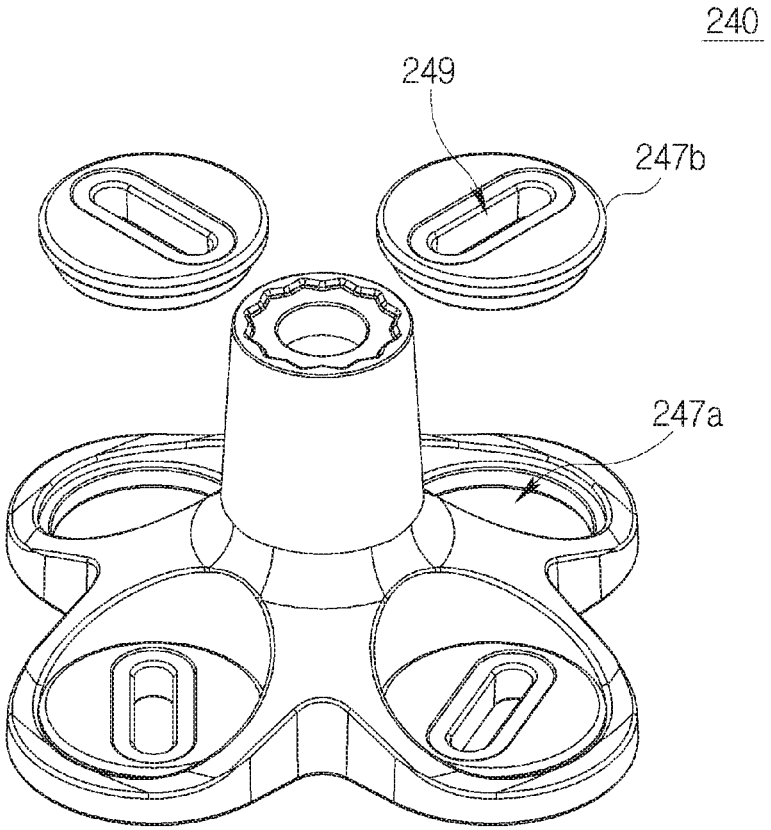
FIG. 7 is a view showing a base portion of the pedestal according to embodiments of the present disclosure.

FIG. 6 is a view showing an upper surface of the pedestal according to embodiments of the present disclosure, and FIG. 7 is a view showing a base portion of the pedestal according to embodiments of the present disclosure. Referring to FIGS. 1 to 7, multiple base nuts 247*a* are formed in the base portion 245. In some embodiments, the base nuts 247*a* may refer to openings formed in the base portion 245. For example, the base nuts 247*a* may be openings formed by passing through the upper and lower surfaces of the base portion 245.

Multiple base bolts 247*b* are coupled to the multiple base nuts 247*a*, respectively. In some embodiments, the base bolts 247*b* may be coupled to the base nuts 247*a* through rotatable engagement. For example, each of the base nuts 247*a* and the base bolts 247*b* may include a thread, and the base bolts 247*b* may be rotated by 360 degree angles in a z-axis direction (e.g., a direction perpendicular to the first direction D1 and the second direction D2) to be coupled to the base nuts 247*a*.

The base nuts 247*a* and the base bolts 247*b* may have a circular shape, but embodiments of the present disclosure are not limited thereto.

Each of the base nuts 247*a* and each of the base bolts 247*b* may be paired, and each pair may be referred to as a base assembly 247. The base assemblies 247 are arranged along the extending directions of the first and second beam elements 210 and 220. In some embodiments, four base assemblies 247 may be arranged on the base portion 245, but embodiments of the present disclosure are not limited to the number of base assemblies 247. For example, when the four base assemblies 247 are formed on the base portion 245, on one base portion 245, two base assemblies may be symmetrically arranged with respect to the connection portion 243 along the first direction D1, and remaining two base assemblies may be symmetrically arranged with respect to the connection portion 243 along the second direction D2.

As will be described later, the base portion 245 of the pedestal 240 and the first and second beam elements 210 and 220 are coupled to each other through the base assemblies 247. In some embodiments, the base assemblies 247 may be seated on the upper surfaces of the first and second beam elements 210 and 220 to couple the first and second beam elements 210 and 220 and the pedestal 240 to each other.

A slot 249 is formed in each of the base bolts 247*b*. In some embodiments, each of the slots 249 may include an opening linearly extending on each of the base bolts 247*b*. For example, each of the slots 249 may be a longitudinal hole formed in each of the base bolts 247*b* in an elliptical shape. Meanwhile, when the base nuts 247*a* and the base bolts 247*b* are rotatably coupled to each other, the slots 249 are rotated in cooperation with rotation of the base bolts 247*b*.

For example, when each of the base bolts 247*b* has a circular shape, each of the slots 249 may have two portions symmetrically opposed with respect to the diameter of the base bolt 247*b*.

Figure 8:
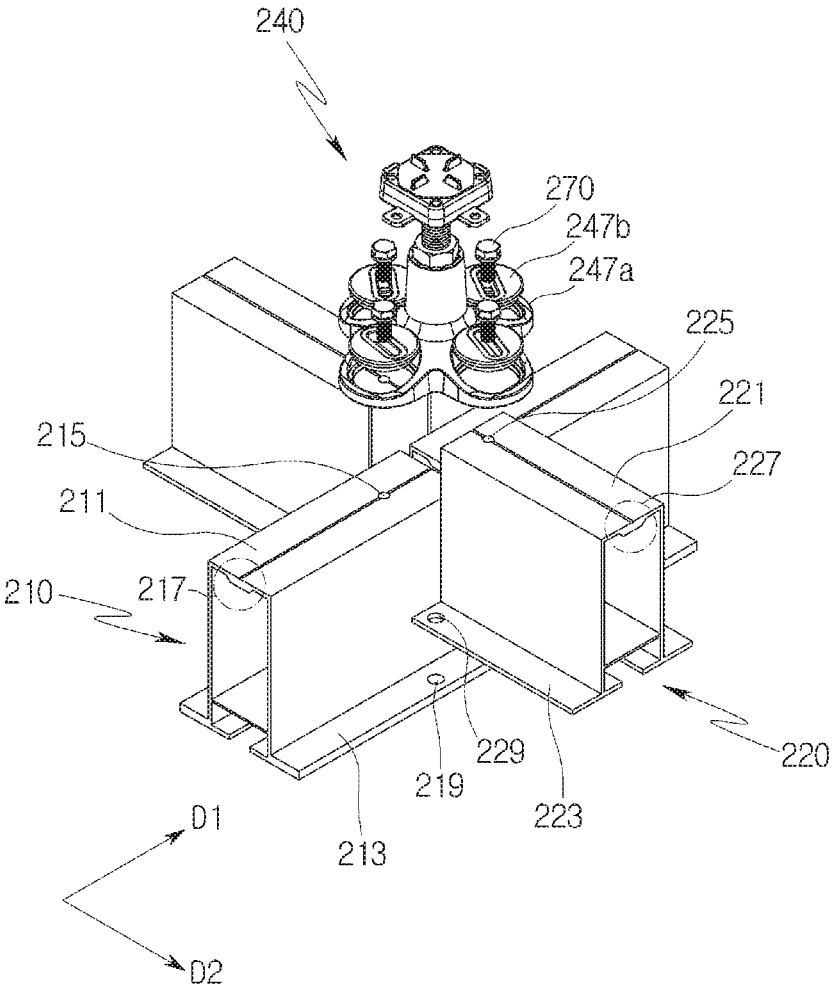
FIG. 8 is a view showing a process of assembling the pedestal and the beam elements according to embodiments of the present disclosure.

FIG. 8 is a view showing a process of assembling the pedestal and the beam elements according to embodiments of the present disclosure. Referring to FIGS. 1 to 8, the second wings 223 of the second beam elements 220 are seated on the first wings 213 of the first beam elements 210. Herein, the second wings 223 are seated on the first wings 213 such that the first lower holes 219 and the second lower holes 229 are aligned with each other. Beam element coupling bolts are passed through the first lower holes 219 and the second lower holes 229 to couple the first wings 213 and the second wings 223 to each other. When the first wings 213 and the second wings 223 are coupled to each other, the heights of the upper surfaces of the first beam elements 210 and the second beam elements 220 become the same.

The pedestal 240 is seated on the upper surfaces of the first beam elements 210 and the second beam elements 220. In some embodiments, the pedestal 240 may be seated such that the base assemblies 247 of the pedestal 240 are located on the respective upper surfaces of the first and second beam elements 210 and 220. The pedestal 240 may be seated on the upper surfaces of the first and second beam elements 210 and 220, with the base nuts 247*a* and the base bolts 247*b* coupled to each other.

In some embodiments, the pedestal 240 may be seated on the upper surfaces of the first and second beam elements 210 and 220 such that the first and second upper holes 215 and 225 are located in openings of the base nuts 247*a* of the base assemblies 247. For example, the pedestal 240 may be seated on the upper surfaces of the first and second beam elements 210 and 220 such that the slots 249 and at least portions of the first and second upper holes 215 and 225 overlap each other.

The first and second beam elements 210 and 220 and the pedestal 240 are coupled to each other by pedestal connection members 270. In some embodiments, the pedestal connection members 270 may be fastened to the first and second beam elements 210 and 220 by being passed through the pedestal 240. For example, the pedestal connection members 270 may be passed through the slots 249 of the pedestal 240 to be inserted into the first and second upper holes 215 and 225 of the first and second beam elements 210 and 220.

The pedestal connection members 270 may be bolts, but are not limited thereto. In some embodiments, the pedestal connection members 270 may refer to any elements that can be passed through the slots 249 and inserted into the first and second upper holes 215 and 225.

According to the present disclosure, due to the fact that the pedestal connection members 270 are inserted into the upper holes of the beam elements through the slots 249 of the pedestal 240, it is ensured that the pedestal 240 and the first and second beam elements 210 and 220 are firmly coupled to each other. This therefore provides an advantage in that deformation and distortion of the first and second beam elements 210 and 220 due to the gravity load of the floor panel 100 are reduced.

Figure 9:
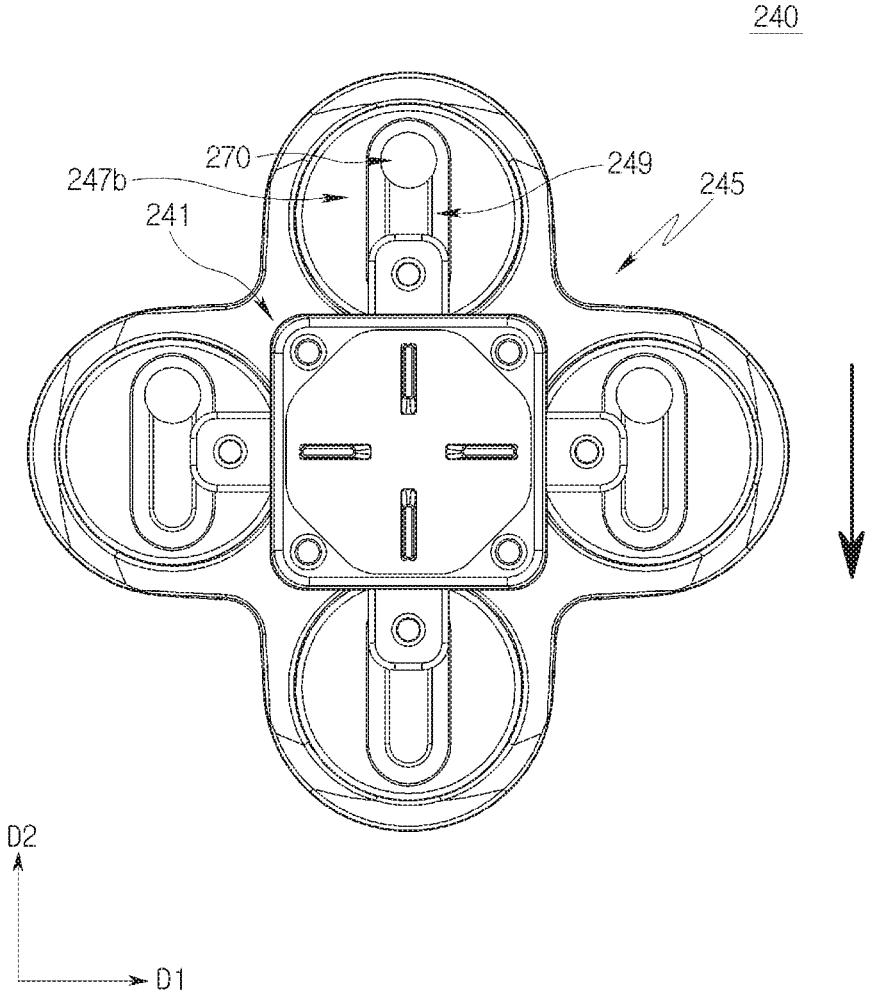
FIGS. 9 to 11 are views showing movement of the pedestal according to embodiments of the present disclosure.
Figure 10:
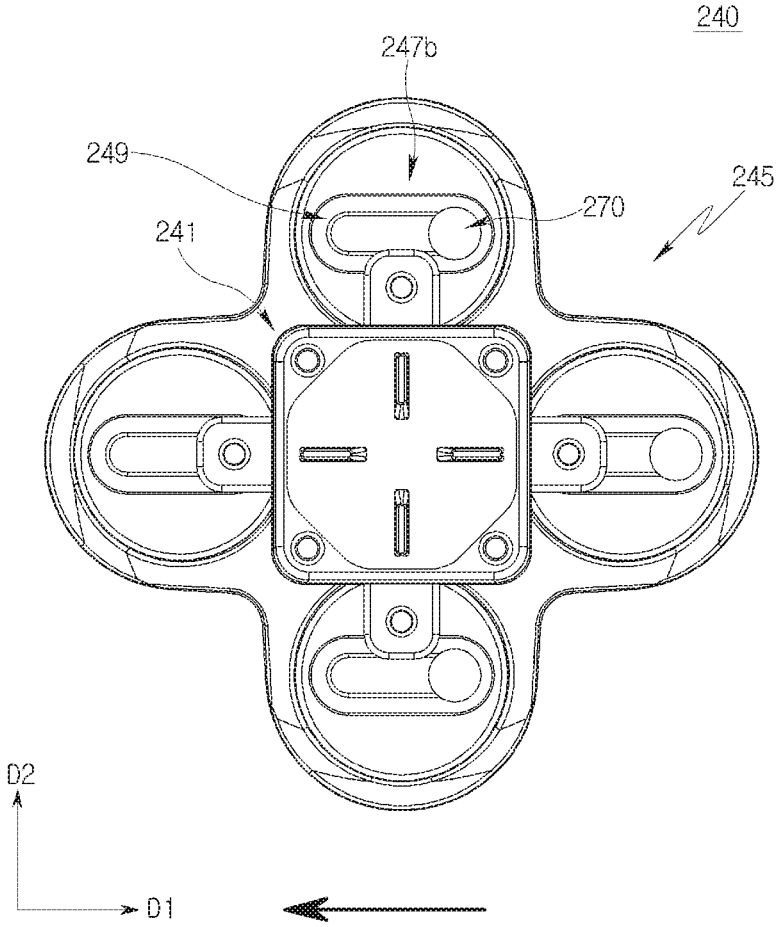
Figure 11:
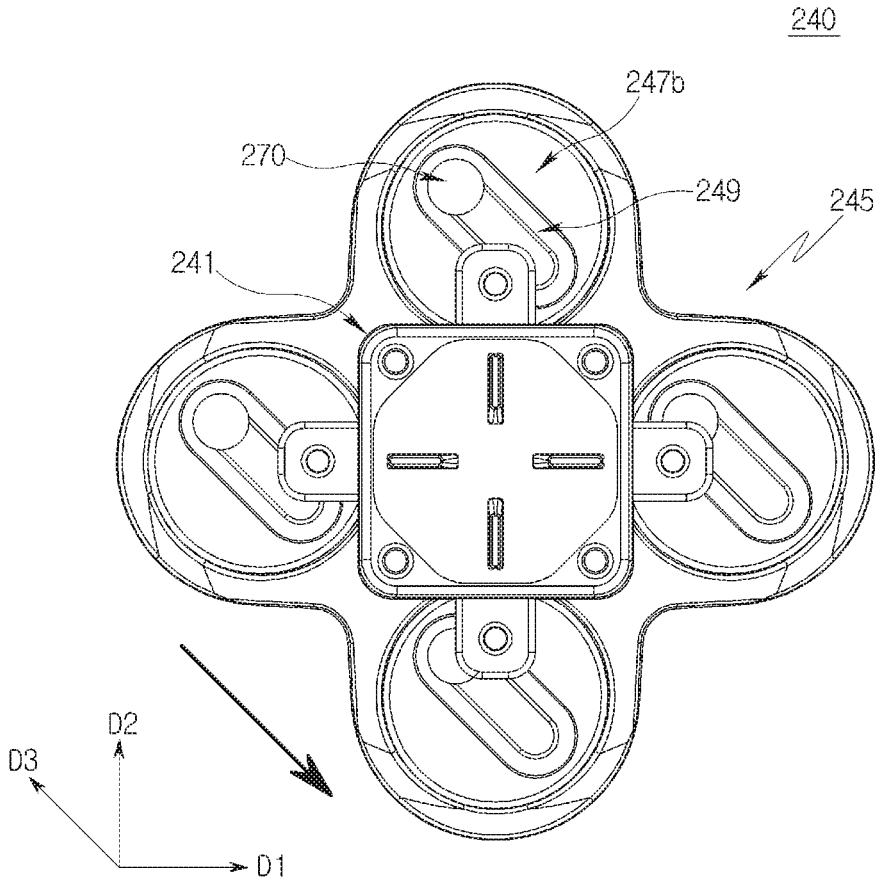

FIGS. 9 to 11 show movement of the pedestal according to embodiments of the present disclosure. Referring to FIGS. 1 to 11, the pedestal connection members 270 are received in the slots 249 and the first and second upper holes 215 and 225. Although not shown in FIGS. 9 to 11, it is assumed that the pedestal connection members 270 are in a state of being inserted into the first and second upper holes 215 and 225 and fastened to the first and second beam elements 210 and 220.

In some embodiments, the pedestal connection members 270 may be fastened to the first and second beam elements 210 and 220 by being passed through the slots 249 and the first and second upper holes 215 and 225.

The pedestal connection members 270 are received in the slots 249 while being fastened into the first and second upper holes 215 and 225, such that the pedestal 240 is movable through engagement between the pedestal connection members 270 and the slots 249. This configuration allows the pedestal 240 to be seated on the first and second beam elements 210 and 220 so as to be movable within the range that is defined by the length of the slots 249.

In some embodiments, each of the slots 249 may include an opening linearly extending on each of the base bolts 247*b*, and the pedestal 240 may be movable within the range that is defined by the length of the openings through engagement between the pedestal connection members 270 and slots 249. Meanwhile, the pedestal connection members 270 are inserted into and fastened in the first and second upper holes 215 and 225. Accordingly, the first and second upper holes 215 and 225 and the pedestal connection members 270 are fixed in position so as not to be movable, while the pedestal 240 is movable within the range defined by the length of the openings of the slots 249. Due to such a configuration, it is ensured that the pedestal 240 is movably seated on the first and second beam elements 210 and 220. For example, the pedestal 240 may be seated on the first and second beam elements 210 and 220 so as to be movable within the range defined by the length of the openings of the slots 249.

Even after the pedestal connection members 270 are passed through the pedestal 240 and the first and second upper holes 215 and 225 and fastened to the first and second beam elements 210 and 220, the pedestal 240 is movable along longitudinal directions of the slots 249 within the range defined by the length of the openings of the slots 249. The movable range of the pedestal 240 on the first and second beam elements 210 and 220 is proportional to the size of the openings of the slots 249, which means that the movable range of the pedestal 240 is controllable by controlling the size of the openings of the slots 249. In some embodiments, due to the fact that the slots 249 are formed in the base bolts 247*b* and the base bolts 247*b* are rotatable, the slots 249 may be rotated in cooperation with rotation of the base bolts 247*b* when the base bolts are rotated. When the slots 249 are rotated, a moving direction of the pedestal 240 may be changed. For example, when the slots 249 are rotated by 90 degree angles, the moving direction of the pedestal 240 may be changed by 90 degree angles. As a result, it is ensured that the pedestal 240 may be movable in all directions on the upper surfaces of the first and second beam elements 210 and 220.

According to the present disclosure, there is an advantage of securing stability of coupling between the pedestal 240 and the first and second beam elements 210 and 220, while securing mobility of the pedestal 240. There is another advantage of controlling horizontal displacement of the pedestal 240, without requiring a change in locations of the first and second upper holes 215 and 225.

The position of the pedestal 240 when the pedestal connection members 270 are located at the respective centers of the base bolts 247*b* or the slots 249 may be referred to as a reference position. For example, at the reference position, an intersecting point of the first and second beam elements 210 and 220 and a central point of the pedestal 240 may coincide with each other. In some embodiments, the pedestal 240 may be moved in a horizontal direction from the reference position.

As shown in FIG. 9, the pedestal connection members 270 received in the slots 249 may be located at positions changed from the centers of the slots 249 in the second directions D2. In this case, the pedestal 240 may be moved in a direction opposite to the second directions D2, that is, in a downward direction based on FIG. 9, and seated on the first and second beam elements 210 and 220.

As shown in FIG. 10, the base bolts 247*b* may be rotated by 90 degree angles clockwise from the positions of the base bolts 247*b* of FIG. 9. Accordingly, the pedestal connection members 270 received in the slots 249 may be located at positions changed from the centers of the slots 249 in the first directions D1. In this case, the pedestal 240 may be moved in a direction opposite to the second directions D2, that is, in a left direction based on FIG. 10, and seated on the first and second beam elements 210 and 220.

As shown in FIG. 11, the base bolts 247*b* may be rotated by less than 90 degree angles (e.g., 45 degree angles) counterclockwise from the positions of the base bolts 247*b* of FIG. 9. Accordingly, the pedestal connection members 270 received in the slots 249 may be located at positions changed from the centers of the slots 249 in third directions D3. In this case, the pedestal 240 may be moved in a direction opposite to the third directions D3, that is, in a right-upward direction based on FIG. 11, and seated on the first and second beam elements 210 and 220.

As described above, due to the fact that the support structure 200 according to the embodiments of the present disclosure includes the pedestal 240 that is height-adjustable, there is an advantage of efficiently adjusting the distance between the support structure 200 and the floor panel 100.

According to embodiments of the present disclosure, due to movable engagement between the slots 249 of the pedestal 240 and the pedestal connection members 270, which connect the pedestal 240 and the first and second beam elements 210 and 220 to each other, there is an advantage in that the pedestal 240 seated on the first and second beam elements 210 and 220 is movable in all directions. Accordingly, even when the center of the pedestal 240 is not located at the intersecting point of the unit panels 110 due to installation accumulated tolerances or other construction reasons, this can be solved by easily moving the position of the pedestal 240 to various positions.

Furthermore, according to the embodiments of the present disclosure, due to the fact that the pedestal 240 and the first and second beam elements 210 and 220 are coupled to each other using the pedestal connection members 270, there is an advantage in that the support structure 200 is increased in stability.

Furthermore, according to the embodiments of the present disclosure, due to the fact that the pedestal 240 and the first and second beam elements 210 and 220 are coupled to each other using the pedestal connection members 270 without requiring provision of any separate structure, there is an advantage in that the pedestal 240 is easy to mount on the first and second beam elements 210 and 220, thus simplifying a manufacturing process.

Furthermore, according to the embodiments of the present disclosure, due to movable engagement between the pedestal connection members 270 the slots 249 of the base bolts 247*b* of the pedestal 240, there is an advantage in that the pedestal 240 is easy to move on the first and second beam elements 210 and 220, without requiring provision of any separate structure formed on the first and second beam elements 210 and 220 for movement of the pedestal connection members 270, thus simplifying a manufacturing process.

Although the exemplary embodiments of the present disclosure have been described for illustrative purposes, those skilled in the art will appreciate that various modifications, additions and substitutions are possible, without departing from the scope and spirit of the invention as disclosed in the accompanying claims. Accordingly, it should be understood that the present disclosure includes various modifications, additions and substitutions without departing from the scope and spirit of the invention as disclosed in the accompanying claims.

What is claimed is:

1. A support structure on which a floor panel is seated, the support structure comprising:

a plurality of first beam elements disposed in a first direction;

a plurality of second beam elements disposed in a second direction perpendicular to the first direction;

a post supporting at least part of the plurality of first beam elements and the plurality of second beam elements; and a plurality of pedestals seated on top of the plurality of first beam elements and the plurality of second beam elements, and supporting the floor panel, wherein each of the plurality of pedestals seats on top of a pair of first beam elements and a pair of second beam elements, wherein the pedestal includes:

a base portion comprising four base assemblies and four pedestal connection members;

a head portion supporting the floor panel; and a connection portion inserted into the base portion and the head portion, wherein the connection portion is a height-adjustable thread, wherein each of the four pedestal connection members connects the base portion with each of the pair of the first beam elements and the pair of the second beam elements by passing through each of the four base assemblies.

2. The support structure of claim 1, wherein the first beam element includes a first body portion, and a first wing protruding outward from the first body portion, the second beam element includes a second body portion, and a second wing protruding outward from the second body portion, and any one of the first wing and the second wing is seated on a remaining one of the first wing and the second wing.

3. The support structure of claim 2, wherein the first wing includes a first lower hole, the second wing includes a second lower hole, and the first wing and the second wing are connected to each other through a beam element connecting member inserted into the first lower hole and the second lower hole.

4. The support structure of claim 1, wherein the base assembly includes:

a base nut with an opening, formed in the base portion; and a base bolt rotatably coupled to the base nut, wherein the base bolt includes a slot formed therein.

5. The support structure of claim 4, wherein the first beam element includes a first upper hole, the second beam element includes a second upper hole, and the pedestal connection members is inserted into the first upper hole or the second upper hole by passing through the slot and the base nut.

6. The support structure of claim 4, wherein the slot includes an opening linearly extending on the base bolt, and the pedestal connection member is received in the slot such that the pedestal is movable within a range defined by a length of the openings of the slot, whereby the pedestal is movably seated on the top of the pair of first beam elements and the pair of second beam elements.

7. The support structure of claim 1, wherein the head portion includes a seat guide portion protruding from an upper surface of the head portion by a predetermined thickness, and wherein the seat guide portion is affixed to the floor panel.

8. The support structure of claim 1, further comprising:

stringers connected to the pedestal and extending in the first direction and the second direction, wherein the stringers support the floor panel together with the pedestal.

9. An access floor system, comprising:

a floor panel; and a support structure supporting the floor panel, wherein the floor panel includes multiple unit panels, and the support structure includes:

a plurality of first beam elements disposed in a first direction;

a plurality of second beam elements disposed in a second direction perpendicular to the first direction;

a post supporting at least part of the plurality of first beam elements and the plurality of second beam elements; and a plurality of pedestals seated on top of the plurality of first beam elements and the plurality of second beam elements, and supporting the floor panel, wherein each of the plurality of pedestals seats on top of a pair of first beam elements and a pair of second beam elements, wherein the pedestal includes:

a base portion comprising four base assemblies and four pedestal connection members;

a head portion supporting the floor panel; and a connection portion inserted into the base portion and the head portion, wherein the connection portion is a height-adjustable thread, wherein each of the four pedestal connection members connects the base portion with each of the pair of the first beam elements and the pair of the second beam elements by passing through each of the four base assemblies.

10. The support structure of claim 9, wherein the base assembly includes:

a base nut with an opening, formed in the base portion; and a base bolt rotatably coupled to the base nuts, wherein the base bolt includes a slot formed therein.

11. The support structure of claim 10, wherein the first beam element includes a first upper hole, the second beam element includes a second upper hole, and the pedestal connection members is inserted into the first upper hole or second upper hole by passing through the slot and the base nut.

12. The support structure of claim 10, wherein the slot includes an opening linearly extending on the base bolt, and the pedestal connection members is received in the slot such that the pedestal is movable within a range defined by a length of the openings of the slot, whereby the pedestal is movably seated on the top of the pair of first beam elements and the pair of second beam elements.

* * * * *